US005270500A

United States Patent [19]

Guiney

[11] Patent Number: 5,270,500

[45] Date of Patent: Dec. 14, 1993

[54] BAIL ACTUATION OF AUXILIARY CONTACTS

[75] Inventor: Bruce D. Guiney, Tucker, Ga.

[73] Assignee: Siemens Energy & Automation, Inc., Alpharetta, Ga.

[21] Appl. No.: 936,964

[22] Filed: Aug. 28, 1992

[51] Int. Cl.[5] ..... H01H 3/00

[52] U.S. Cl. ..... 200/17 R

[58] Field of Search ..... 200/15, 17 R, 18, 50 A, 200/50 C; 335/6-13

[56] References Cited

U.S. PATENT DOCUMENTS 4,724,512 2/1988 Bischof et al. ..... 200/50 A X
5,053,590 10/1991 Vierling ..... 200/203
5,072,081 12/1991 Sepelak et al. ..... 200/144 R

*Primary Examiner*—J. R. Scott
*Attorney, Agent, or Firm*—Richard M. Ludwin

[57] ABSTRACT

A safety switch is provided with an auxiliary contact that is actuated by the heel of the bail. The heel actuation enables the auxiliary switch to be easily installed and wired and enables the same actuator and bracket to be used for varying sizes of bails.

7 Claims, 6 Drawing Sheets

BAIL ACTUATION OF AUXILIARY CONTACTS

BACKGROUND OF THE INVENTION a. Field of the Invention

This invention is related to electrical safety switches.

b. Related Art

Switches commonly require one or more auxiliary contacts for functions such as annunciation or motor controller operation. The auxiliary contacts are typically provided by way of an additional or auxiliary switch, mounted in the same housing as the main switch. When used for annunciation, the contacts of the auxiliary switch are typically disposed so as to close after the main switch closes and to open before the main switch opens. This ensures a positive operation of other circuit protection devices correctly sequenced with the main switch contact operation. An example of a prior art spring operated electrical safety switch is shown in FIG. 1. The switch of FIG. 1 is provided with movable contact carriers 102, each of which holds an electrically conductive contact 104. The contact carriers 102 are mounted on a spring loaded bail 106, which is pivotally mounted to the switch housing 108 by way of a pin 107 and a drive shaft 116. Multiple pairs of stationary electrical contacts 110, 112 are also mounted within the switch housing 108 so as to receive the movable contacts 104 when the switch is "on". One electrical contact 110 in each pair is connected to a line voltage while the other electrical contact 112 in each pair is connected to a load. A handle 114 is connected to the bail 106 by way of the drive shaft 116 and an operating cam 118. A spring 120 is also mounted to the switch housing 108 and coupled to the bail 106 so as to bias the bail 106 in a position such that each of the movable contacts 104 will be brought into mechanical and electrical connection with a corresponding pair of the stationary contacts 110, 112. A rod 122, centered within the spring transfers the force of the spring to the cam 118. By pulling the handle 114, the user loads the spring 120 which, in turn, pivots the bail 106 into an "over center" position away from the stationary contacts, thus leaving the switch in an "off" or "open" position.

When the handle 114 is lifted in an upward direction by the user, the cam 118 pivots the bail 106. Once pivoted beyond the center position, in the direction of the stationary contacts 110, 112, the bail 106 slips from the handle 114 as the spring 108 pushes the bail 106 into place. When the bail is in place in it's spring biased position, the movable contacts 104 each make mechanical and electrical connection between a corresponding pair of stationary contacts 110, 112, thus placing the switch into a "on" or "closed" position.

An enlarged view of the bail 106, the pin 107, a movable contact carrier 102, a movable contact 104 and a pair of stationary contacts 110, 112 is illustrated in FIG. 2. As is known in the art, an auxiliary switch 124 may be mounted in a position within the housing such that the top end (carries portion) 106*a* of the bail 106 (the section on which the contact carriers 102 are mounted) will cause the auxiliary switch 124 to be "closed" just after the bail 106 and contacts 104 are pulled into a "closed" position by the spring 108. The switch 124 is provided with an actuator 126 on a side facing the bail and wiring contacts on the opposite side.

While the above-described configuration provides a suitable auxiliary contact in many situations, one problem with such switches is that the configuration does not readily lend itself to the use of larger current rated versions of conventional top wired/bottom actuated switches since the space within the cabinet below the bail bar is highly limited. Instead, the prior art switches often resort to smaller/lower current rated switches, mounting external to the mechanism and/or non-conventional switch configurations or wiring arrangements.

For example, mounting a conventional top-wired/-bottom actuated micro-switch in the position shown in FIG. 1 would place the wire contact screw at the bottom and leave it relatively inaccessible. Further, while an actuator could be devised, a different one would typically be required for each different bail diameter.

SUMMARY OF THE INVENTION

In light of the above, the present invention comprises an improved safety switch. The safety switch is provided with an auxiliary contact that is actuated by the heel of the bail. Advantageously, heel actuation enables the auxiliary switch to be easily installed and wired and enables the same actuator and bracket to be used for varying sizes of bails.

BRIEF DESCRIPTION OF THE DRAWING

The present invention will be better understood by reference to the drawing, in which.

Like reference numerals appearing in more than one FIGURE represent like elements.

DETAILED DESCRIPTION OF THE PREFERRED EMBODIMENT

Figure 3:
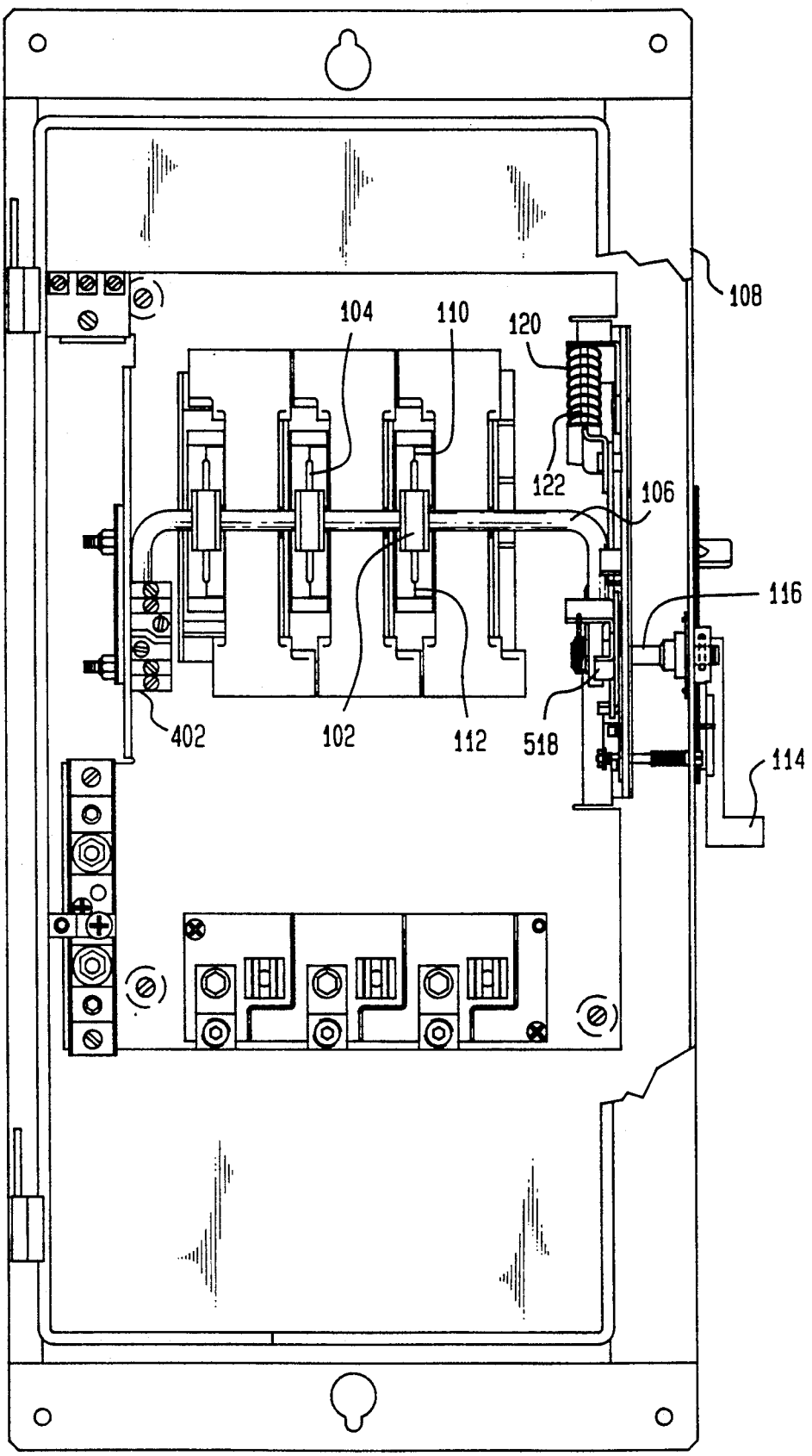
FIG. 3 is a front view of an improved safety switch according to an embodiment of the present invention.

An improved safety switch according to an embodiment of the present invention is illustrated in FIG. 3. Except where indicated herein, all components remain as described with respect to FIG. 1.

The switch of FIG. 3 has a number of advantages or aspects. According to a first aspect, the safety switch is provided with an auxiliary contact that is actuated by the heel of the bail. According to a second aspect, the safety switch is provided with a torsion spring, which biases the bail in an open position. The torsion spring is connected to the bail release cam such that the switch is made resistant to inadvertent closing caused by gravity and mechanical shock.

Figure 4:
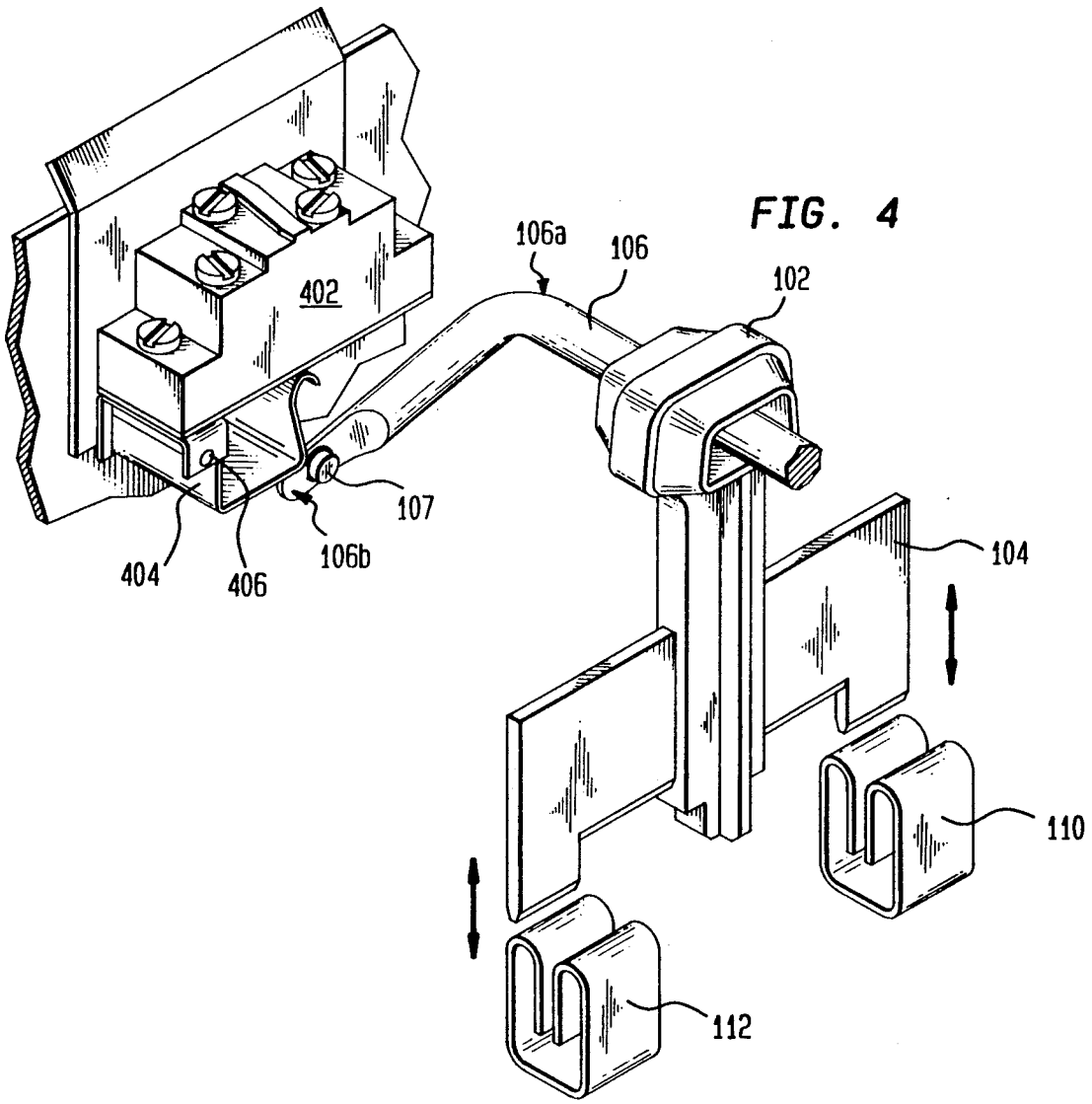
FIG. 4 is an enlarged view of the bail actuated auxiliary switch mechanism in the switch of FIG. 3; and, FIG. 5 is an enlarged view of a torsion spring mechanism for bail biasing in the switch of FIG. 3.

The placement of the auxiliary contacts, according to an embodiment of the present invention, are illustrated in FIG. 4. A bottom actuated, top wired momentary contact switch 402 is mounted to the slide plate of the switch housing 108. A "U" shaped actuator 404 (preferably having a flat bottom) is pivotally mounted from a bracket 406 which extends from the side plate. The actuator 404 and the bracket 406 are positioned below the switch 402 as illustrated. The actuator 404 is placed in the housing such that it will be depressed by the heel 106*b* of the bail 106 as the bail is rotated downward, and after the movable contacts 104 have engaged the stationary contacts 110, 112.

As the bail 106 rotates downward, the moveable contacts 104 engage the stationary contacts 110, 112. After they are engaged, the heel of the bail rotates the actuator 404 to close the contacts of the auxiliary switch 402. As the bail 106 rotates upward, the heel of the bail 106 rotates downward, allowing the actuator 404 to release pressure on the auxiliary switch 402, permitting it to open. As the bail 106 continues to rotate upward, it disengages the moveable contacts 104 from the stationary contacts 110, 112.

Advantageously, heel actuation of the auxiliary switch enables the auxiliary switch to be mounted in such a way that it can be conveniently wired according to the same convention as the main switch. Consider the momentary switch 402 of FIG. 4. If the switch were to be actuated by the carrier portion of the bail, it would have to be mounted with its wiring terminals face down in the box. This "face down" wiring increases the difficulty of access and, in a crowded housing, would likely necessitate removal of the auxiliary switch for rewiring.

Further, consider a wiring convention where the line (hot) is at the top of the housing and the load is at the bottom of the housing. In safety switches embodied as illustrated in FIG. 4, the auxiliary switch can be wired according to the same convention as the main switch (line at the top/ load at the bottom). In auxiliary switches with predetermined line and load terminals, the wiring convention would be reversed if the auxiliary switch were mounted in the "terminals down" so that the carrier portion of the bail could accomplish the auxiliary switch actuation.

Figure 1:
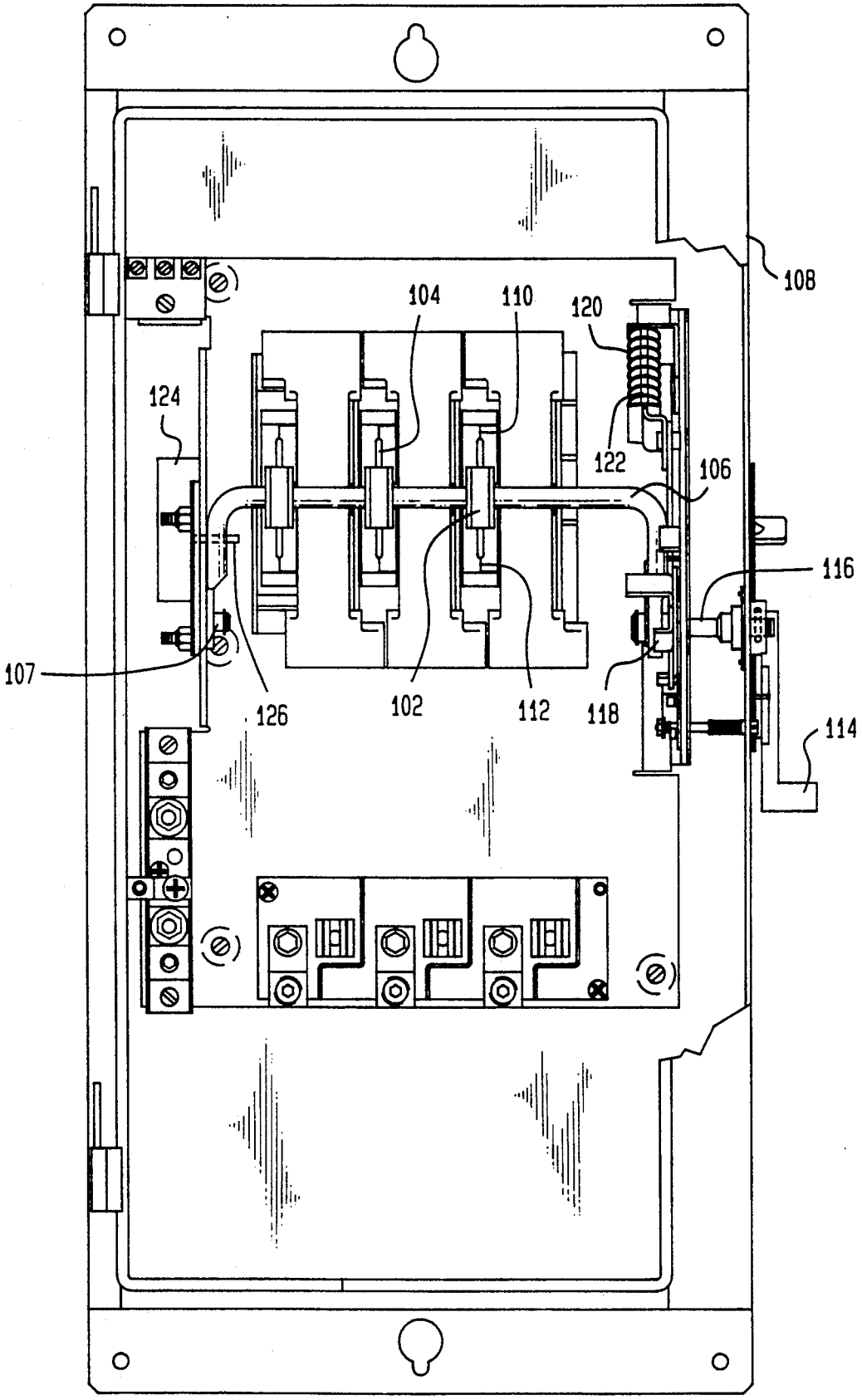
FIG. 1 (PRIOR ART)
FIG. 1 is a front view of a prior art safety switch.
Figure 2:
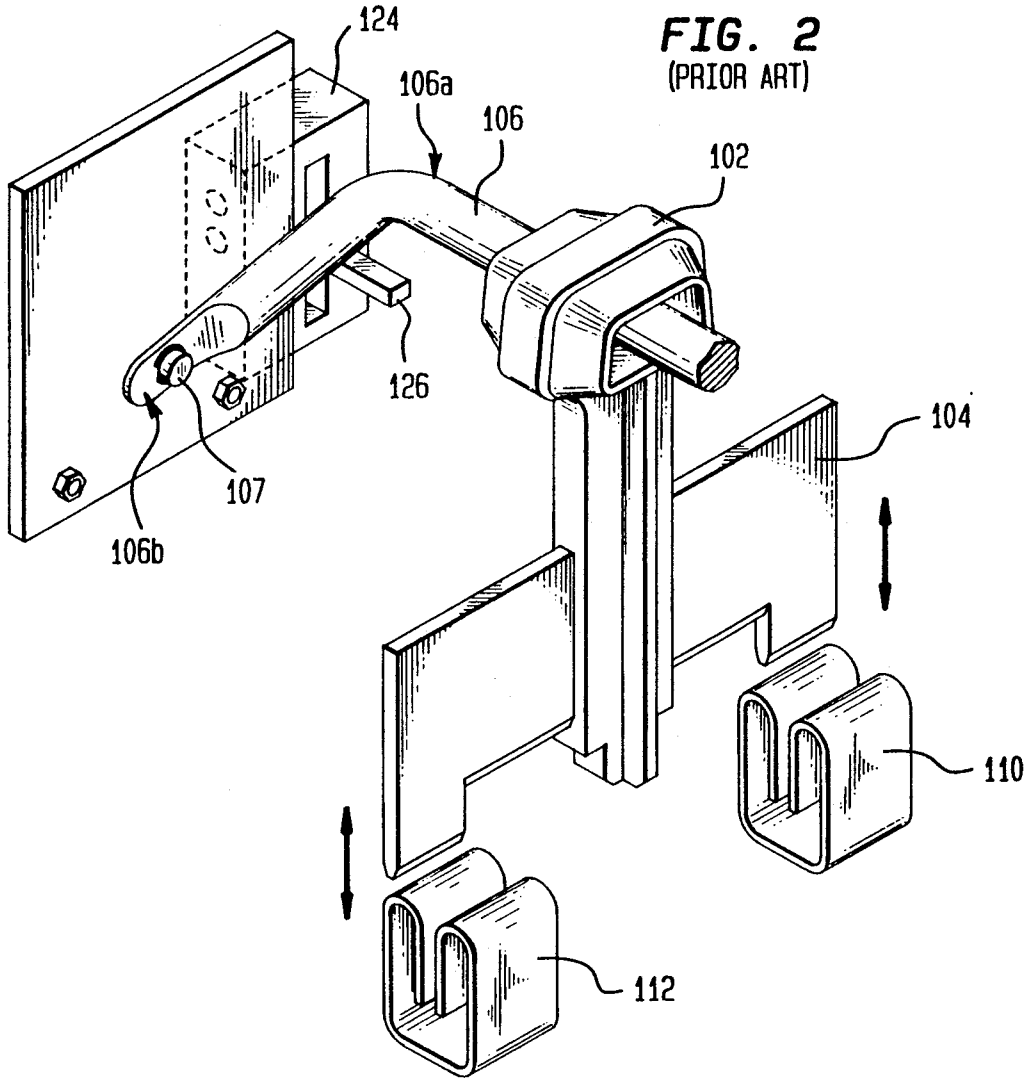
FIG. 2 (PRIOR ART)
FIG. 2 is an enlarged view of a portion of the bail and contacts in the switch of FIG. 1.
Figure 5:
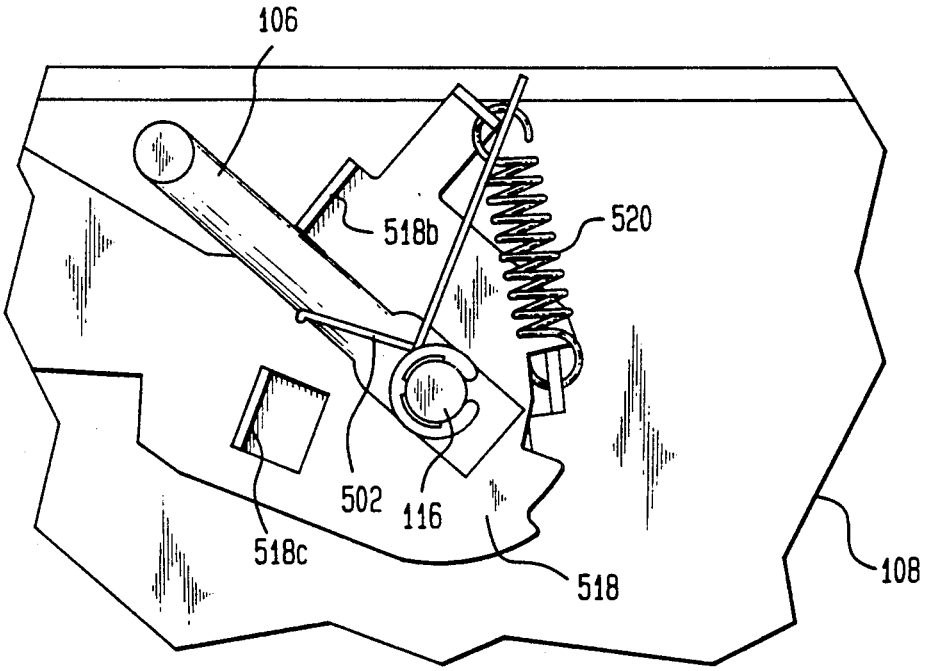
Figure 6:
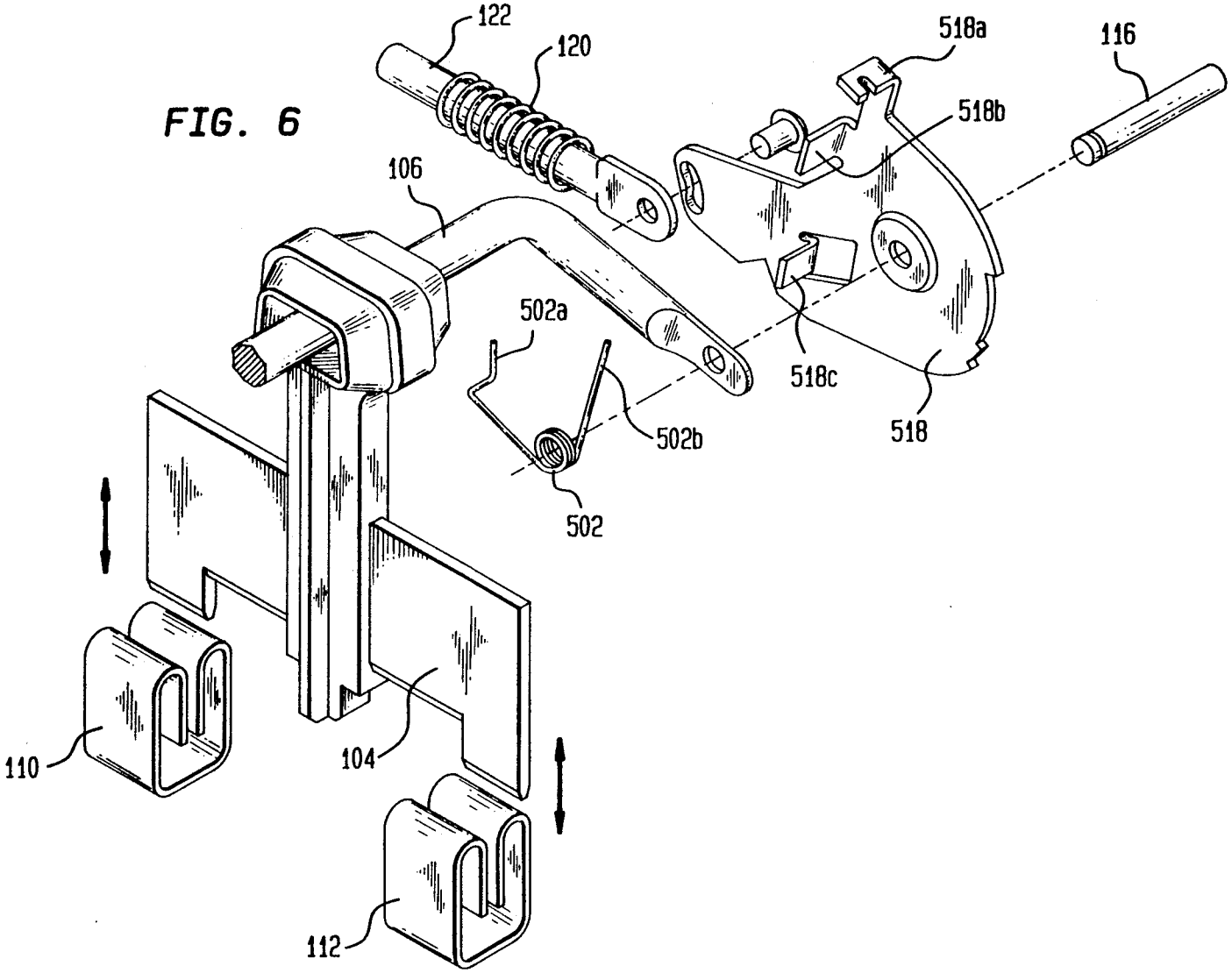
FIG. 6 is an exploded view of a torsion spring mechanism for bail biasing in the switch of FIG. 3.

The application of a torsion spring to the safety switch of FIG. 3 is illustrated in FIGS. 5 and 6. As best shown in FIG. 6, the cam 118 of FIG. 1 is replaced with a modified cam 518 having a tab with a notch 518*a*. The coil portion of a torsion spring 502 is positioned over the drive shaft 116. The formed leg 502*a* of the torsion spring 502 is hooked under the adjacent leg of the bail 106. The straight leg 502*b* of the torsion spring 502 is inserted into the notch 518*a* provided for that purpose in the cam 518.

The bail 106 is placed between an upper stop 518*b* and a lower stop 518*c* of the cam 518. The torsion spring 502 exerts a force on the bail 106 holding it against the upper stop 518*b* on the cam 518. This prevents the movable contacts 104 from be placed, by gravity or mechanical shock, into inadvertent engagement with the stationary contacts 110, 112. As illustrated in FIG. 5, a handle biasing spring 520 can be provided so as to ensure that the position of the handle 114 (See FIG. 3) is indicative of the position of the cam 518.

Now that the invention has been described by way of the preferred embodiment, various enhancements and improvements which do not depart from the scope and spirit of the invention will become apparent to those of skill in the art. Thus it should be understood that the preferred embodiment has been provided by way of example and not by way of limitation. The scope of the invention is defined by the appended claims.

I claim:

1. An electrical switch, comprising:

a housing;

a bail pivotally mounted to the housing, the bail having a heel portion and a carrier portion;

a first electrically conductive contact mounted on the carrier portion of the bail;

second and third electrically conductive contacts mounted in the housing so as to make an electrical connection with the first electrically conductive contact when the bail is in a first position; and, an auxiliary switch mounted in the housing and having an actuator disposed within a translational path of the heel portion of the bail;

wherein, the auxiliary switch is closed by the heel portion of the bail moving along the translational path and depressing the actuator just subsequent the bail being placed in the first position.

2. The switch of claim 1 wherein the actuator is "U" shaped and is mounted adjacent to the auxiliary switch to a side of the housing.

3. The switch of claim 1 further comprising a spring coupled to the housing and to the bail so as to bias the bail into the first position.

4. An electrical switch, comprising:

a housing;

a bail pivotally mounted to the housing, the bail having a heel portion and a carrier portion;

a first switch mounted in the housing and actuated by the carrier portion of the bail; and, an auxiliary switch mounted in he housing and having an actuator disposed within a translational path of the heel portion of the bail;

wherein, the auxiliary switch is actuated by the heel portion of the bail moving along the translational path and urging the actuator into contact with the auxiliary switch just subsequent to the first switch being actuated by the carrier portion of the bail.

5. The switch of claim 4 wherein the first switch is a knife switch.

6. The switch of claim 5 wherein the auxiliary switch is a momentary contact switch.

7. The switch of claim 6 further comprising a second spring coupled to the bail and the housing so as to bias the first switch in an "open" position when the bail is disposed in an "over center" location.

* * * * *